United States Patent [19]

Melton et al.

[11] 4,274,872

[45] Jun. 23, 1981

[54] BRAZABLE SHAPE MEMORY ALLOYS

[75] Inventors: Keith Melton, Busslingen; Olivier Mercier, Ennetbaden, both of Switzerland

[73] Assignee: BBC Brown, Boveri & Company, Baden, Switzerland

[21] Appl. No.: 51,747

[22] Filed: Jun. 25, 1979

[30] Foreign Application Priority Data

Aug. 10, 1978 [CH] Switzerland ..... 8508/78

[51] Int. Cl.[3] ..... C22C 9/04

[52] U.S. Cl. ..... 75/157.5; 75/159; 75/162

[58] Field of Search ..... 148/11.5 R, 11.5 C, 148/12.7 C, 13.2; 75/153, 157.5, 161, 162, 159

[56] References Cited

U.S. PATENT DOCUMENTS

| | | | |
|---|---|---|---|
| 3,783,037 | 1/1974 | Brook et al. | 148/11.5 R |
| 3,816,187 | 6/1974 | Smith et al. | 148/11.5 C |

*Primary Examiner*—Peter K. Skiff

*Attorney, Agent, or Firm*—Oblon, Fisher, Spivak, McClelland & Maier

[57] ABSTRACT

A brazable shape memory alloy of the $\beta$-brass type comprising a mixture of copper, zinc and aluminum and nickel in an amount effective to inhibit grain growth and a process of brazing therewith.

2 Claims, 1 Drawing Figure

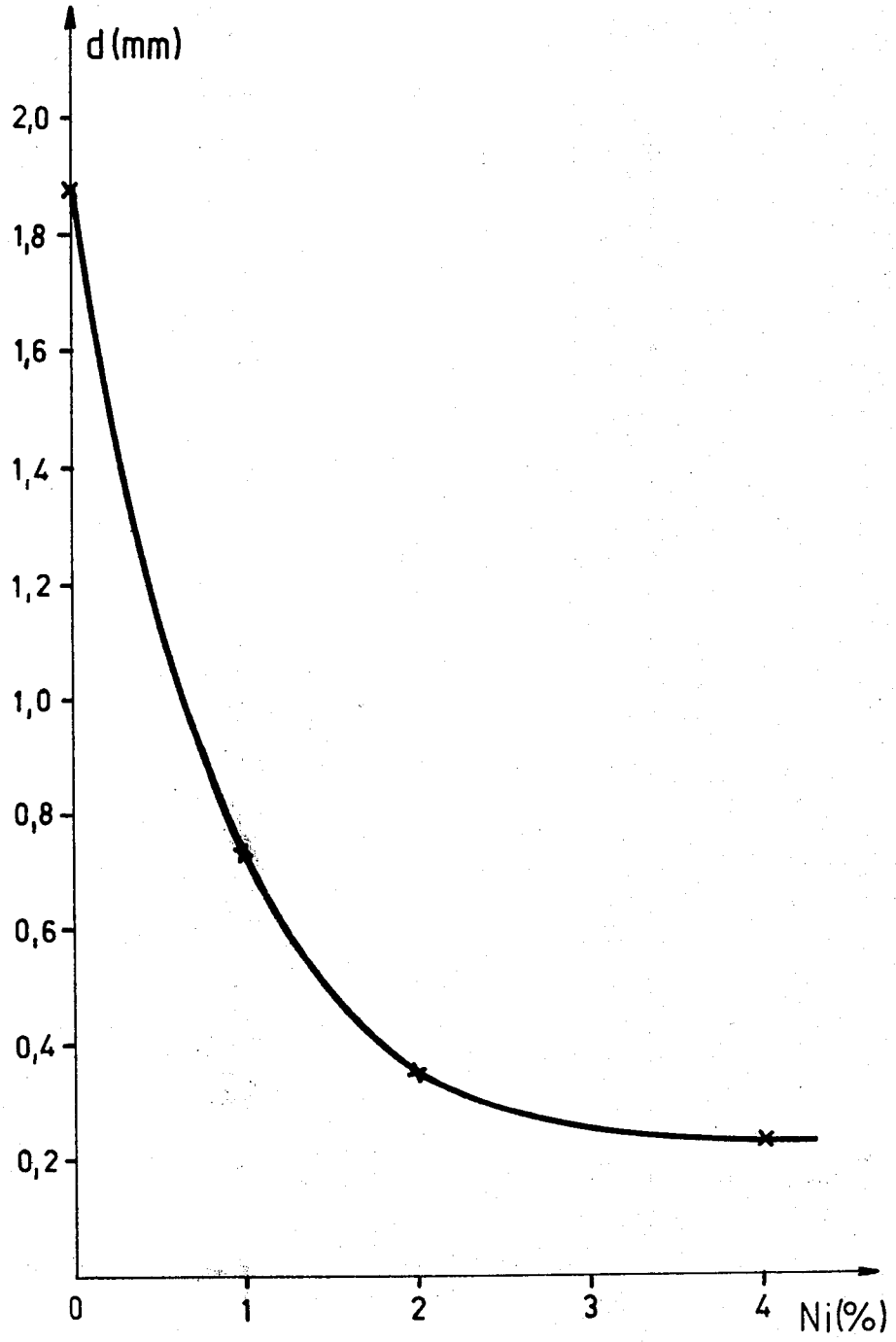
d (mm)
2,0
1,8
1,6
1,4
1,2
1,0
0,8
0,6
0,4
0,2
0
1
2
3
4
Ni(%)

BRAZABLE SHAPE MEMORY ALLOYS

BACKGROUND OF THE INVENTION

1. Field of the Invention

The invention is concerned with a brazable shape memory alloy, β-type brass alloy, and a method of brazing.

2. Description of the Prior Art

Shape memory alloys of the β-brass type (Cu/Zn/Al system) are known (e.g. DE-05 2 711 576; DE-05 2 055 755; AT-PS 333 522). In general, alloys of this type are annealed between 600° C. and 960° C. depending on their composition in order to obtain the highest possible fraction of the β-phase. They are thereupon quenched to below a critical temperature $M_s$ in order to obtain a metastable martensitic phase. $M_s$ can be above or below room temperature depending on the composition. On reheating in the course of subsequent processing (e.g., brazing or soldering) the metastable phase is extensively converted into the stable and the memory effect is lost.

It follows from the above that memory alloys of the type Cu/Zn/Al are, in general, not brazable without their principal physical property, the memory effect, being unacceptably impaired. The melting points of most technical soft solders are sufficiently high into the temperature range at which precipitation of stable phases occur that they can be eliminated from the outset as a method of joining components. On the other hand, brazing alloys have melting points which are in the range of annealing temperatures of the memory alloy and problems can arise from an overlap of these temperatures. Moreover β-brass alloys have a tendency towards excessive grain growth at the high temperatures of brazing, leading to cracking susceptibility, so that joins made in this manner are rejected as being unusable.

A need therefore exists for a brazable shape memory alloy together with an associated brazing process, whereby the memory effect in the final assembled component can be fully used, without the need for additional processing steps or equipment, and wherein the grain growth of the memory alloy resulting from any heating is avoided and its cracking susceptibility effectively reduced.

SUMMARY OF THE INVENTION

Accordingly, one object of the invention is to provide a brazable shape memory alloy.

Another object of the invention is to provide a brazing process for a brazable shape memory alloy.

Another object of the invention is to provide a brazable shape memory alloy which avoids excessive grain growth upon heating.

Another object of the invention is to provide a brazable shape memory alloy with reduced cracking susceptibility.

Briefly, these objects and other objects of the invention as hereinafter will become more readily apparent can be attained by providing brazable shape memory alloys of β-brass type comprising copper, zinc and aluminum with the addition of nickel as grain refiner.

Furthermore, there is provided a process of brazing a memory alloy β-brass type component with other metallic components in which the so formed workpiece (the assembled components), after brazing, is completely brought to the solution temperature of the β-phase of the memory alloy and subsequently quenched.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein:

The FIGURE is a graph of the grain size as a function of the Ni content for a Cu/Zn/Al/Ni-alloy.

DETAILED DESCRIPTION OF THE PREFERRED EMBODIMENT

The essential idea behind the invention consists in using a brazing alloy whose temperature of flowing lies sufficiently high above the annealing temperature of the shape memory alloy β-brass type, so as to guarantee in each case the minimum requirement of strength and the ability to retain the shape of the brazed join and at the same time inhibit the grain growth at higher temperatures of the memory alloy by choosing a suitable composition.

The brazable shape memory alloys of the invention are of the β-brass type comprising a mixture of copper, zinc and aluminum which contains nickel in an amount sufficient to inhibit grain growth at the high temperature at which the alloy is treated.

The grain growth inhibition by nickel in the brazable shape memory alloys of this invention is readily discernible by reference to the FIGURE.

The grain size, d, in mm is shown in the FIGURE as a function of the nickel content for a series of memory alloys of the type Cu/Zn/Al/Ni. The alloys studied were solution treated for 5 minutes at 950° C., in order to convert their structure fully into that of the β-phase, and then quenched into water. Their compositions varied within the limits:

| | |
|---|---|
| Zinc: | 22% |
| Aluminum: | 8% |
| Copper: | 70% to 66% |
| Nickel: | 0% to 4% |

The sum of the copper plus nickel content was thus always 70%. The grain refining action of the nickel addition can be clearly seen from the FIGURE. While the average grain diameter of the nickel free Cu/Zn/Al alloy was about 1, 9 mm, the addition of only 0.5% nickel brought a reduction to about two thirds of this value, while, 1% nickel brought a reduction to almost one third of this value. At a nickel content of 4%, the grain diameter of a little over 0, 2 mm had been reduced to almost a tenth of the original value of conventional alloys of this type. On the other hand, nickel additions of more than 4% produced no significant further reduction in grain diameter.

All Cu/Zn/Al/Ni alloys consisting predominantly of the β-phase with about 0.5 to 4% nickel can be used. The requirements are satisfied for example by alloys of the following composition:

| | |
|---|---|
| Zinc: | 1 to 25% |
| Aluminum: | 6 to 15% |
| (Requirement 15% ≦ Al + Zn ≦31%) | |
| Nickel: | 0.5 to 4% |

-continued

| | |
|---|---|
| Copper: | 65 to 85% |

Alloys of the following composition are preferably used:

| | |
|---|---|
| Zinc: | 12 to 18% |
| Aluminum: | 7 to 9% |
| Nickel: | 0.5 to 4% |
| Copper: | balance, but maximum 85% |

The new memory alloys corresponding to the invention make possible the manufacture of crack-free and dense brazed joins between components of a memory alloy and another metallic material, without impairing any of the memory properties during the brazing process.

The brazing process using the shape memory alloy of $\beta$-brass type of this invention comprises brazing the shape memory alloy of the $\beta$-brass type with a high temperature brazing alloy using a flux which inhibits the formation of an aluminum-rich oxide layer, at a temperature above the minimum temperature necessary for a solid solution anneal of the shape memory alloy of the $\beta$-brass type and then the shape memory alloy is subjected to a solution heat treatment at a temperature below the melting point of the brazing alloy and the brazed workpiece is finally quenched from the solution heat treatment temperature.

The brazing temperature should be sufficient to transform as large a portion as possible of the shape memory alloy into that of the $\beta$-phase. Generally, a bright red heat (about 850° C.) is sufficient for this purpose.

The solution heat treatment temperature should be less than the temperature of flow of the brazing alloy but sufficiently high so as to allow homogenization of the shape memory alloy into the $\beta$-phase. Generally, a dull red heat (about 700° C.) is sufficient for this purpose.

The length of time during which the brazed workpiece is subjected to the solution heat treatment is sufficient to allow homogenization of the shape memory alloy into the $\beta$-phase. Generally, a few minutes is all that is required, preferably 5 minutes.

According to the brazing process of this invention, the shape memory alloy may be allowed to cool to room temperature after brazing and then be brought back to a temperature suitable for the solution heat treatment. Alternatively, the shape memory alloy may be allowed to cool only to a suitable heat treatment temperature, after brazing. Whichever method is used, after the solution heat treatment, the shape memory alloy is then quenched. Suitably, water is used as the quenching medium.

In carrying out the process, attention should be paid that the melting temperature of the braze is sufficiently high above the solution treatment temperature of the memory alloy, which must be reached in order to transform the structure of as large a fraction as possible (ideally 100%) into that of the $\beta$-phase. The flux used during soldering should prevent as far as possible oxidation of aluminum and formation of an aluminum-rich oxide layer.

Having generally described this invention, a further understanding can be obtained by reference to certain specific examples which are provided herein for purposes of illustration only and are not intended to be limiting on the scope thereof.

EXAMPLE I

A memory alloy belonging to the $\beta$-brass type was melted in an induction furnace under an argon atmosphere in a graphite crucible and its composition was:

| | |
|---|---|
| Zinc: | 14.5% |
| Aluminum: | 8% |
| Nickel: | 2% |
| Copper: | balance |

The thus prepared ingot was then rolled at a temperature of 850° C. to a 5 mm thick sheet. A disc of 27 mm diameter was machined out of this sheet. The alloy of the above composition has a martensitic transformation temperature $M_s$ of +60° C. A cylinder 15 mm long was cut from a copper rod of 15 mm diameter. The pieces to be coaxially brazed together, the memory alloy disc and the copper cylinder, were coated on their front faces with the flux "Tenacity 5" (Trade name of the British firm Johnson Matthey). Thereupon the copper cylinder was placed upon the disc and both pieces were heated with a propane flame to a bright red heat corresponding to a temperature of about 850° C. and brazed with a brazing alloy L-Ag5 according to the specification DIN 8513 (Composition 5% Ag, 55% Cu, 40% Zn). The workpiece was subsequently cooled to room temperature, surplus flux, brazing alloy and adhering dirt removed and cleaned. In order to convert the memory alloy into the $\beta$-phase and to homogenise it, the cleaned workpiece was solution treated for 5 minutes at a temperature of 700° C. and quenched into water. The completed workpiece was then cut longitudinally so that the joint could be examined. The brazing showed itself to be defect free and no cracks could be detected at or near the braze.

EXAMPLE II

A memory alloy of the following composition was melted in an induction furnace using the method given in Example I and then rolled to plate.

| | |
|---|---|
| Zinc: | 16.5% |
| Aluminum: | 8% |
| Nickel: | 2% |
| Copper: | balance |

This alloy has a martensite transformation temperature $M_s$ of −50° C. Corresponding to Example I, a piece each of copper and memory alloy were prepared and brazed together using the described materials. Instead of cooling to room temperature from the brazing temperature of 850° C., the propane flame was so adjusted that the workpiece only cooled to a dull red heat (700° C.), when it was held for a few minutes at this temperature and then quenched into water. The examination of the longitudinally cut work piece revealed a defect-free brazed join.

Having now fully described this invention, it will be apparent to one of ordinary skill in the art that many changes and modifications can be made thereto without departing from the spirit or scope of the invention set forth herein.

What is claimed as new and intended to be covered by Letters Patent is:

1. A brazable shape memory alloy of the $\beta$-brass type comprising a mixture of copper, zinc, aluminum and nickel wherein said alloy comprises about 0.5 to about 4 wt. % nickel, 6 to 15 wt. % aluminum, 1 to 25 wt. % zinc and 65 to 85 wt. % copper; and wherein the total amount of aluminum and zinc is greater than or equal to 15 wt. % and less than or equal to 31 wt. %.

2. The brazable shape memory alloy of claim 1, wherein said alloy comprises about 0.5 wt.% to about 4 wt.% nickel, 7 to 9 wt.% aluminum, 12 to 18 wt.% zinc, and copper as the balance.

* * * * *